US012631014B2

(12) United States Patent
Côté et al.

(10) Patent No.: US 12,631,014 B2
(45) Date of Patent: May 19, 2026

(54) MODULAR FABRICATION OF STRUCTURES

(71) Applicant: 12832429 CANADA INC., Saint-Jean-sur-Richelieu (CA)

(72) Inventors: Jean Côté, Morrisonville, NY (US); Éric Méthot, Saint-Jean-sur-Richelieu (CA)

( * ) Notice: Subject to any disclaimer, the term of this patent is extended or adjusted under 35 U.S.C. 154(b) by 366 days.

(21) Appl. No.: 18/335,283

(22) Filed: Jun. 15, 2023

(65) Prior Publication Data

US 2024/0011277 A1 Jan. 11, 2024

Related U.S. Application Data

(60) Provisional application No. 63/358,493, filed on Jul. 5, 2022.

(51) Int. Cl.
*E04B 1/24* (2006.01)
*E04H 1/12* (2006.01)

(52) U.S. Cl.
CPC ..... *E04B 1/2403* (2013.01); *E04H 1/12* (2013.01); *E04B 2001/2463* (2013.01); *E04H 2001/1283* (2013.01)

(58) Field of Classification Search
CPC ..... E04B 1/34384; E04B 1/2403; E04B 1/34352; E04B 2001/2427; E04B 2001/2481; E04B 2001/2484; E04B 1/08; E04B 1/34321; E04B 2001/2463; E04B 1/34336; E04B 1/3483; E04H 1/12; E04H 2001/1283
See application file for complete search history.

(56) References Cited

U.S. PATENT DOCUMENTS

| | | | | |
|---|---|---|---|---|
| 3,310,926 | A | 3/1967 | Brandreth et al. | |
| 3,832,956 | A | 9/1974 | Briel, Jr. | |
| 4,205,497 | A * | 6/1980 | Schirm | C07F 7/123 52/93.2 |
| 4,381,632 | A | 5/1983 | Geitner | |
| 4,782,637 | A * | 11/1988 | Eriksson | E04B 1/3483 312/263 |
| 4,910,932 | A * | 3/1990 | Honigman | E04B 1/08 52/282.4 |
| 5,195,282 | A | 3/1993 | Campbell | |
| 5,237,784 | A * | 8/1993 | Ros | E04B 1/34352 52/79.5 |
| 5,386,788 | A | 2/1995 | Linker et al. | |
| 5,402,608 | A | 4/1995 | Chu | |
| 5,660,005 | A | 8/1997 | Tacoma | |
| 8,347,560 | B2 * | 1/2013 | Gyory | E04B 1/34363 52/79.5 |
| 9,988,806 | B2 | 6/2018 | Segall | |

(Continued)

FOREIGN PATENT DOCUMENTS

| | | | |
|---|---|---|---|
| EP | 2852723 | A1 | 4/2015 |
| JP | 2005089845 | A * | 4/2005 |

*Primary Examiner* — Rodney Mintz
(74) *Attorney, Agent, or Firm* — Anglehart et al.

(57) ABSTRACT

Insulated panels having suitable surface members separated by an inner layer of insulated foam are used for the walls and as structural members for the floor and roof of a building structure. A rigid frame supports the wall, floor and roof insulated panels. The wall insulated panels are supported on the exterior of the frame by rigid brackets with the insulated panels being suitably flashed or capped.

19 Claims, 16 Drawing Sheets

(56) References Cited

U.S. PATENT DOCUMENTS 10,006,193 B1 * 6/2018 Liu ..... E04B 7/063
10,584,476 B2 3/2020 Morgan
10,590,671 B1 3/2020 Jee et al.
10,689,840 B2 * 6/2020 Bonlin ..... E04G 21/14
10,975,562 B2 * 4/2021 Griechen ..... E04B 1/2403
11,021,883 B2 * 6/2021 Izquierdo Jaen ... E04B 1/34336
11,248,372 B2 * 2/2022 Griechen ..... E04B 1/1903
11,326,339 B2 * 5/2022 Cho ..... E04B 1/5831
11,399,628 B2 * 8/2022 Stearns ..... E04B 1/34305
11,965,328 B2 * 4/2024 Kim ..... E04H 1/005
12,129,645 B2 * 10/2024 Parkhouse ..... F16B 7/185
12,221,278 B2 * 2/2025 Ford, III ..... B65G 67/02
12,509,874 B2 * 12/2025 Tanner ..... E04B 1/34384
2006/0277836 A1 12/2006 Chazyn
2007/0044411 A1 3/2007 Meredith et al.
2009/0165401 A1 7/2009 Smalley, III
2010/0269419 A1 * 10/2010 Gyory ..... E04B 1/34384 52/79.5
2011/0179741 A1 7/2011 Yen
2012/0266546 A1 * 10/2012 Gyory ..... E04B 1/3444 52/126.1
2016/0090730 A1 * 3/2016 Segall ..... E04B 1/34384 52/262
2019/0010692 A1 1/2019 Segall
2019/0153720 A1 * 5/2019 Bonlin ..... E04B 1/34317
2019/0217929 A1 * 7/2019 Lefevre ..... B63B 35/44
2019/0226198 A1 * 7/2019 Morgan ..... E04B 1/3483
2019/0338507 A9 * 11/2019 Morgan ..... E04B 1/3483
2020/0146171 A1 * 5/2020 Fotouh ..... E04H 5/00
2020/0149266 A1 * 5/2020 Griechen ..... E04B 2/58
2020/0240158 A1 * 7/2020 Izquierdo Jaen ..... E04H 1/12
2021/0189713 A1 * 6/2021 Griechen ..... E04B 1/08
2021/0317652 A1 10/2021 Kim et al.
2021/0324629 A1 * 10/2021 Brinton ..... E04B 1/80
2022/0047074 A1 2/2022 Stearns et al.
2022/0112707 A1 * 4/2022 Cho ..... E04C 3/04
2023/0125829 A1 * 4/2023 Parkhouse ..... E04B 1/3483 52/79.13
2024/0034552 A1 * 2/2024 Ford, III ..... B65G 67/02
2025/0052053 A1 * 2/2025 Schuster ..... E04B 1/3483
2025/0206522 A1 * 6/2025 Ford, III ..... B65G 67/02
2025/0215685 A1 * 7/2025 Côté ..... E04B 1/08
2025/0361713 A1 * 11/2025 Tanner ..... E04B 1/34384

* cited by examiner

MODULAR FABRICATION OF STRUCTURES

CROSS-REFERENCE TO RELATED APPLICATIONS

This application claims priority from U.S. provisional patent application 63/358,493 filed on Jul. 5, 2022, the contents of which are hereby incorporated by reference.

TECHNICAL FIELD

This patent application relates to systems and methods for allowing the modular fabrication of structures whether for temporary installation or permanent installation and use.

BACKGROUND

Mobile structures are used in a variety of fields requiring non-permanent structures that can quickly and inexpensively be built and dismantled. For example, structures may be built on a construction site to house various equipment or provide a meeting point for planners and workers. Sometimes, structures may also be used for inexpensive permanent living, temporary living such as on a film set filming in the country, or inexpensive solutions for emergency situations requiring structures, such as an emergency hospital. Each use of a mobile structure changes the desired traits of the structure. For example, if the structure is used for living, the structure must merely be large enough to accommodate one individual and their belongings, and ideally be insulated from outside temperatures. If the structure is being used as an emergency hospital, the structure must be large enough to accommodate a number of individuals.

Current structures suffer from certain material limitations. The materials that are used, such as wood, are susceptible to various kinds of damage. For example, current structures suffer greatly from rot, water damage, damage resulting from cold temperatures, damage resulting from living organisms such as termites, among other kinds. There may also be fire hazards.

Current structures also suffer from certain assembly limitations. Current assembly protocols, which involve assembling panels together manually via traditional techniques such as bolting, involve a level of difficulty and require a large amount of time, effort and knowledge to properly assemble.

Currently structures do not currently offer the ability to stack multiple structures on top of each other, and thus cannot make use of vertical space. This creates space constraints as structures are forced to expand horizontally if more structures are required.

Current fabrication methods do not offer the modularity needed to assemble different kinds of structures that respond to the needs of different implementations. Different materials and methods of assembly would need to be used for the fabrication of structures of different sizes and shapes.

SUMMARY OF THE INVENTION

The present disclosure relates to systems and methods for the fabrication of structures that are durable, are resistant to a variety of damage, require little time, effort and knowledge to assemble, are stackable and are modular.

Insulated panels having suitable surface members separated by an inner layer of rigid insulating foam are used for the walls and as structural members for the floor and roof of a building structure. A rigid frame supports the wall, floor and roof insulated panels. The wall insulated panels are supported on the exterior of the frame by rigid brackets with the insulated panels being suitably flashed or capped.

A broad aspect of the present disclosure is a building structure comprising a rigid frame outlining the overall structure, made of rigid beams forming wall posts, floor support beams, and roof support beams, the frame being modular to form structures of a variety of dimensions, a number of rigid brackets connected to and supported by the frame by one of the floor support beams and roof support beams, said brackets comprising a groove, a plurality of insulation panels, for forming walls, a roof and a floor of the structure, wherein the insulated panels forming the walls are placed in the grooves of the brackets to form walls supported and held in place by the brackets, the insulated panels forming the roof are connected to and supported by the roof joists and roof support beams, and the insulated panels forming the floor are connected to and supported by the floor joists and floor support beams, a plurality of flashings connected to and supported by one of the number of brackets, each flashing for covering at least part of one of the number of brackets and one of the plurality of insulation panels and one or more architectural elements imbedded in an aperture that runs through the entire width of at least one of the insulation panels forming the walls, floor or ceiling such that the architectural element can be accessed, the architectural element being at least partly supported by the at least one insulation panels it is imbedded in.

In some embodiments, the insulation panels are of the type having rigid foam insulation material bonded to metal covering opposed major surfaces, opposed side surfaces connectable to adjacent like panels, and end surfaces having exposed rigid foam insulation. In some embodiments, the one of the major surfaces is the innermost layer of the wall of the structure, exposed to the inside of the building, and the other of the major surfaces is the outermost layer of the wall of the structure, exposed to the outside of the building. In some embodiments, the structure may further comprise a rigid plate for covering the exposed rigid foam insulation at the end surfaces of the insulated panels forming the walls of the structure, thereby protecting the inner insulation layer.

In some embodiments, the frame further comprises holes and the brackets further comprise extensions that snap into the holes of the frame, for facilitating installation and locking the brackets into the frame. In some embodiments, the flashings further comprise holes and the brackets further comprise extensions that snap into the holes of the flashings, for facilitating installation and locking the flashings onto the brackets.

In some embodiments, the structure may further comprise one or more rigid sheets that are placed between the insulated panels and the architectural elements for weight distribution and additional sealing of the opening created by the architectural element in the structure and in the exposed insulation layer of the insulated panels in which the architectural element is imbedded.

In some embodiments, the structure may further comprise a rigid corner piece comprising three holes each at a 90-degree angle of each other, for forming an intersection of a wall post with two roof support beams or two floor support beams.

In some embodiments, the rigid beams further form one of roof joists or floor joists for further supporting the insulation panels forming the roof or the floor.

In some embodiments, the architectural element is a door.

In some embodiments, insulated panels are further connected to the brackets by metal-to-metal adhesive.

In some embodiments, the structure may further comprise one or more modular feet capable of connecting non-permanently to a number of structures, said modular feet each comprising a hollow middle area in which connecting structures can be inserted and removed from beneath and square holes in which square, rigid rods of connecting structures can be inserted and removed from the side or in which securing machinery can be connected to secure the structure during shipping.

In some embodiments, the structure may further comprise a pin that can lock the modular feet and connecting structures together, preventing further insertion or removal.

In some embodiments, the frame further comprises one or more stacking interfaces on the frame which allow two or more structures to be stacked, said staking interface comprising a bulb-like protrusion which is thinner on one end and thicker at the other to facilitate stacking of one structure on another. In some embodiments, the stacking interface is connected to the frame via a threaded section on the stacking interface that can be screwed into a complimentary threaded section on the frame, in such a way that it can be added or removed. In some embodiments, the stacking interface connects to the modular feet of another structure by being inserted from beneath the modular foot.

In some embodiments, the structure may further comprise one or more lifting interfaces on the frame which allow for the frame, and by extension the structure, to connect to lifting machinery and be lifted from the one or more lifting interfaces, said lifting interface comprising a half-cylinder-shaped donut with a large hole that can be connected to lifting machinery. In some embodiments, the lifting interface is connected to the frame via a threaded section on the stacking interface that can be screwed into a complimentary threaded section on the frame, in such a way that it can be added or removed.

In some embodiments, the structure may further comprise one or more wheels connected to the frame, that would allow the structure to be moved on wheels. In some embodiments, the wheels comprise a rigid square rod to be inserted in the modular feet, allowing non-permanent connection to the frame via the modular feet.

In some embodiments, the structure may further comprise one or more anchor screws that are drilled into the ground and connected to the frame, to anchor the structure to the ground. In some embodiments, the anchor screws comprise a rigid square rod to be inserted in the modular feet, allowing non-permanent connection to the frame via the modular feet.

In some embodiments, the structure may further comprise one or more extensions that are set in one or more concrete foundations and connected to the frame, to anchor the structure to the concrete foundation. In some embodiments, the extensions comprise a rigid square rod to be inserted in the modular feet, allowing non-permanent connection to the frame via the modular feet.

It should be noted that a key aspect of the present disclosure is its modularity. The rigid frame can be fabricated to have a number of lengths, widths and heights, or may even be fabricated to be in different shapes than a rectangle. The frame and insulated panels may be fabricated to accommodate a number of architectural elements, or none. The structure may be fabricated with stacking interfaces for the purposes of stacking, or not. Due to the modularity of the system, it is impossible to describe every possible implementation of it. The modularity of the design effectively allows the consumer to adapt the structure to their particular needs, offering flexibility.

The present disclosure is further described in the detailed description. It should be clear to one skilled in the art of the multiple applications of the present disclosure, which cannot all be summarized in this application.

BRIEF DESCRIPTION OF THE DRAWINGS

The system of the present disclosure will be better understood by way of the following detailed description of embodiments of the invention with reference to the appended drawings, in which.

DETAILED DESCRIPTION

The present disclosure relates to systems and methods for the fabrication of structures that are durable, are resistant to a variety of damage, require little time, effort and knowledge to assemble, are stackable and are modular.

In some aspects, the structure may include a rigid frame and insulated panels. The rigid frame may include or be one or more rigid beams, one or more brackets that may be used to hold insulated panels in place, one or more stacking interfaces, one or more lifting interfaces, and/or one or more modular feet that can accomplish a variety of functions. The nature of each part of the structure will be described in detail below, in reference to the respective figures.

Figure 1A:
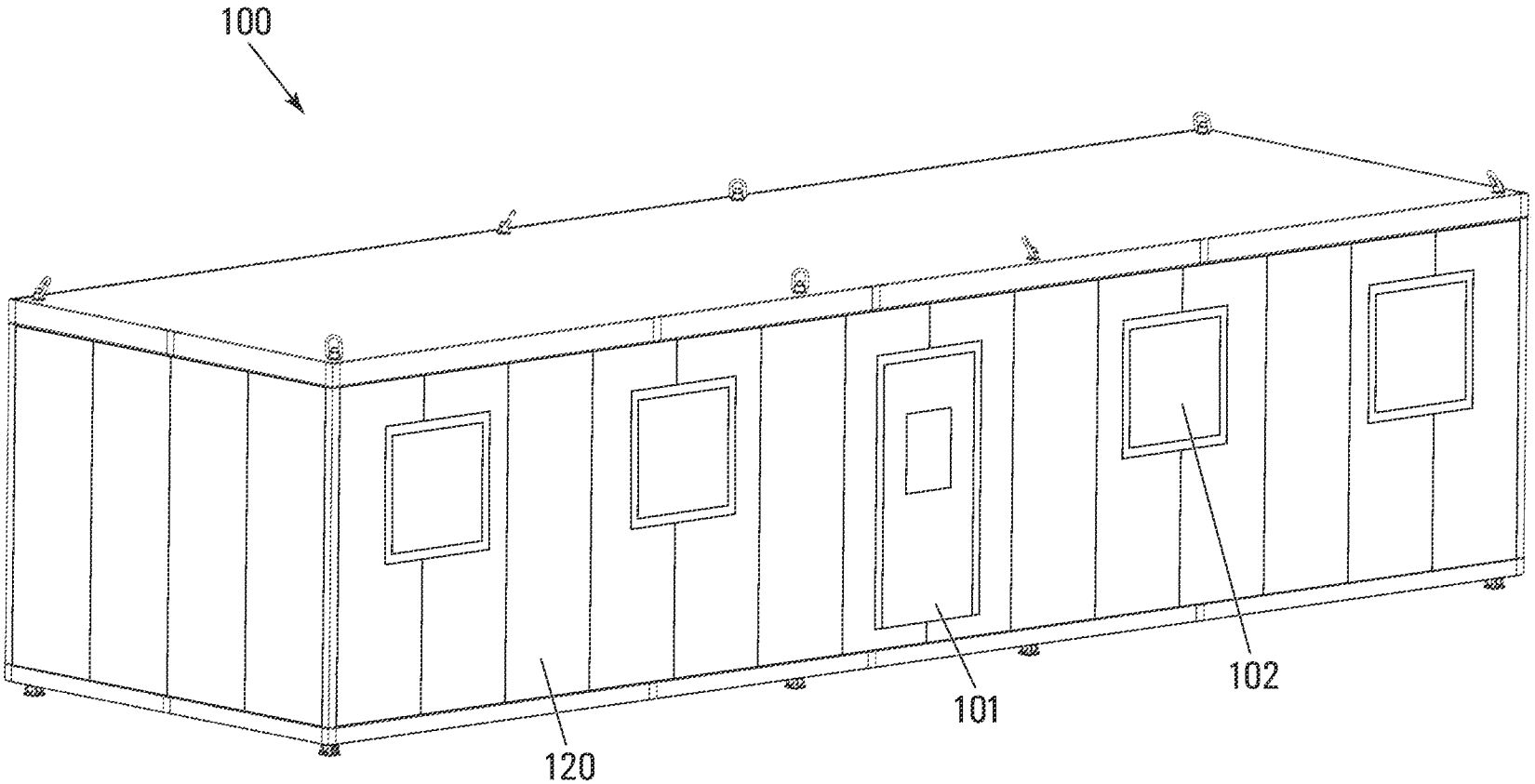
FIG. 1A is an oblique view of a structure that may be fabricated by the systems and methods in this disclosure.
Figure 1B:
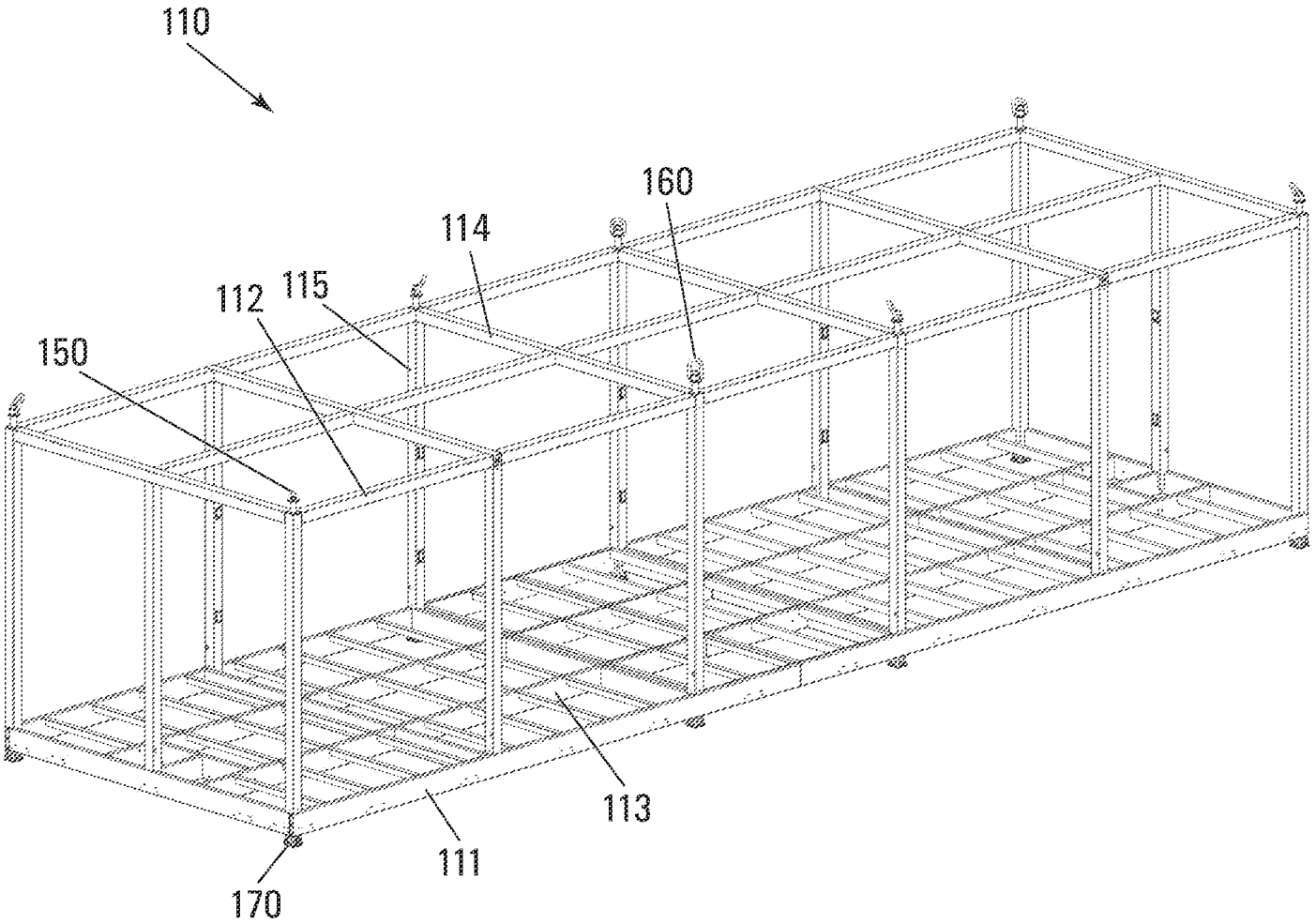
FIG. 1B is an oblique view of the same structure with the insulated panels removed.
Figure 1D:
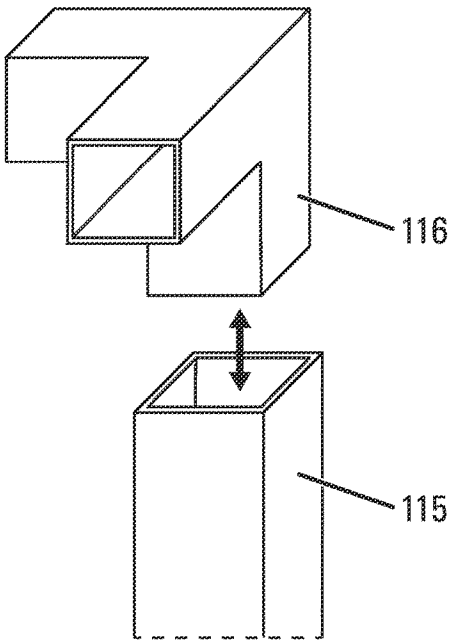
FIG. 1D illustrates an oblique view of a corner connector being inserted into a wall post.

FIG. 1A is an oblique view of a structure that may be fabricated by the systems and methods in this disclosure. In this exemplary embodiment, the structure 100 is a rectangular structure commonly used, for example in construction, and may include a rigid frame 110, insulated panels 120, and/or a variety of architectural elements, including a door 100 and four windows 102. FIG. 1B is an oblique view of the same structure with the insulated panels removed. In this exemplary embodiment, the structure 100 is a rectangular structure commonly used, for example in construction, however the insulated panels 120 have been removed so that the reader can view the rigid frame 110 and how certain extensions of the rigid frame 110, such as a stacking interface 150 (further discussed in reference to FIG. 3), a lifting interface 160 (further discussed in reference to FIG. 4) and modular feet 170 (further discussed in reference to FIG. 5), are connected to the rigid frame 110.

In some embodiments, the rigid frame may be formed from a combination of rigid beams of different shapes and sizes, forming various structures. In some embodiments, such structure that may be formed by the rigid beams may include floor joists 113, floor support beams 111, roof joists 114, roof support beams 112, and wall posts 115. In some embodiments, roof or floor joists may not be necessary. In the exemplary embodiments of FIGS. 1A and 1B, the rigid frame may be formed by rigid beams welded together, forming a rectangular shape. The roof joists 114 may run along or across the roof and may support panels forming the roof. The floor joists 113 may run along or across the floor and may support panels forming the floor. In some embodiments, the rigid beams may be connected in other fashions than welding, such as via glue, bolts, nails or a combination of methods.

In some embodiments, the rigid beams may come in a variety of shapes. In an exemplary embodiment that will be seen in FIG. 2A and FIG. 2B, the rigid beams may come in the form of hollow square beams or T-shaped beams. The shape of the beam is variable in different embodiments. Even other shapes not disclosed in the present application, such as hollow cylinder beams, are also possible.

In some embodiments, the rigid frame and rigid beams may be made with steel or other materials. In the present disclosure, they are referred to as 'rigid beams' and 'rigid frame' for convenience. Steel represents a preferred embodiment. However, a number of other materials with similar characteristics of rigidity and resistance to damage, such as aluminum, may be used. In some embodiments, other materials such as wood may also be used, for being easier to work with and potentially less expensive. Various modifications may need to be undertaken in order to accommodate these other materials (such as fireproofing the structure if wood is used), such modifications will be described later in the specification.

Figure 1C:
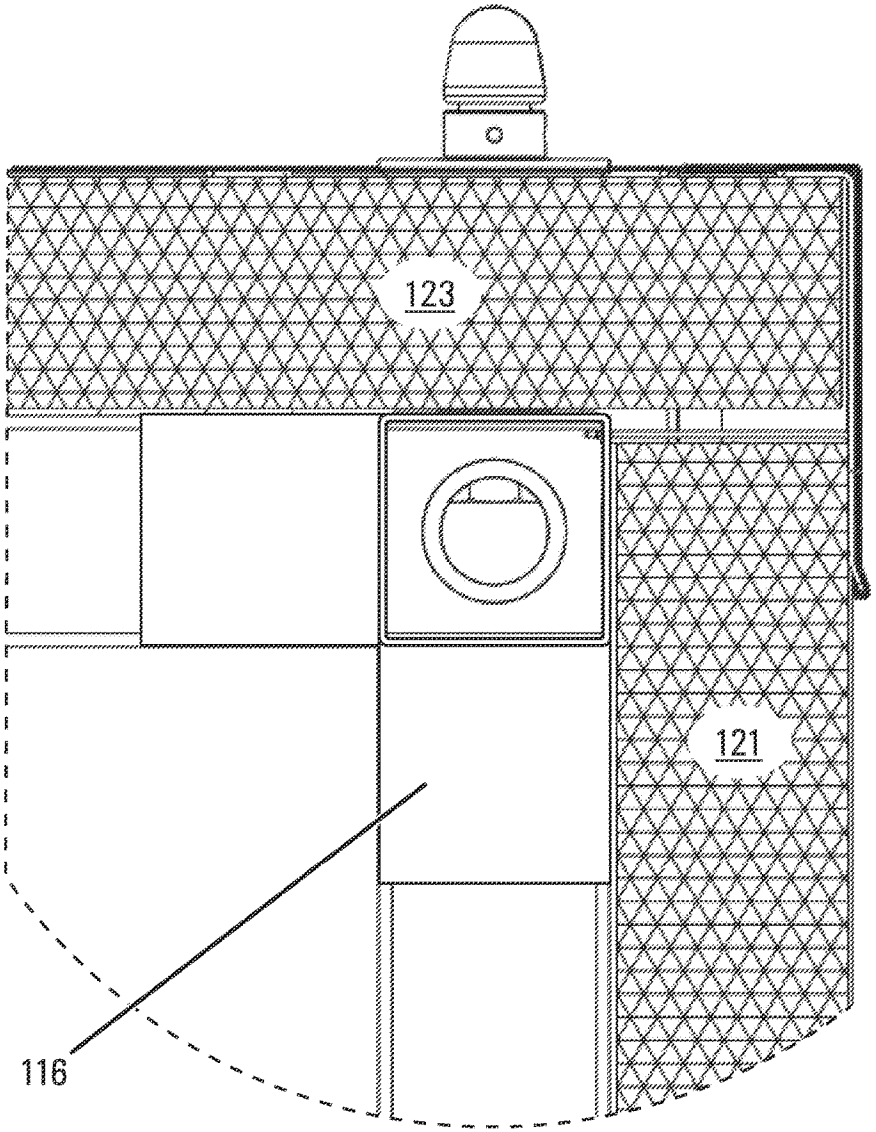
FIG. 1C shows a partial sectional view of a top corner of a structure having a corner connector.

In some embodiments, the rigid frame may further include a corner connector 116, as seen in FIG. 1C. A corner connector 116 may be used to facilitate assembly and may be used in conjunction with rigid beams to form a corner of a structure, here, the corner between a wall 121 and a roof 123 formed by insulated panels. In some embodiments, a corner connector may work by fitting over or into one or more rigid beams and immobilizing them in a particular orientation. In some embodiments, the corner connector may be designed to fit snugly in the shape of a rigid beam. In other embodiments, the corner connector may be designed to be slightly larger or smaller than necessary such that there is room for adhesive, tape or other connecting materials in between the corner connector and the rigid beams. This may be especially useful if assembly is to be performed on site with limited access to specialized equipment or personnel, such as welding equipment to form corners from rigid beams.

In some embodiments, a structure may have a variety of different shapes, widths, heights, or lengths. The rigid frame of a structure would accordingly change to match its features. A square rigid frame would be constructed for a square structure, a rectangular rigid frame would be constructed for a rectangular structure, and so on.

In some embodiments, the structure may be outfitted with insulated panels (also sometimes referred to merely as panels). In some embodiments, the insulated panels may include two outer layers of steel that are separated by an inner layer of insulated foam. The outer layers of steel provide the insulated panels with a significant amount of durability, as well as a significant amount of resistance to various kinds of damage, including but not limited to water damage, rot damage, sun damage, physical damage form mechanical collisions, and damage resulting from high or low temperatures. The inner layer of insulated foam provides the insulated panel with insulation, allowing the panel to minimize temperature exchange between the environments which the insulated panels separate. For example, the insulated panels may provide a structure with significant protection from cold during the winter. In some embodiments, the inner layer of the insulated panel may form the innermost layer of the wall of the structure (thus being on the inside of the room), and the outer layer may form the outermost layer of the wall (thus being exposed to outside elements). In some embodiments, the steel layers may not cover every side of the insulation layer, thus resulting in the insulation layer being exposed on some sides of the insulated panel. The insulated panels may or may not be continuously manufactured. The insulated panels may or may not be designed to be load bearing.

In other embodiments, the insulated panels may include customized insulated panels which may be formed by an insulation layer, an inner material and an outer material. The inner and outer materials may be different, and thus provide separate advantages for an inner and outer environment. For example, an inner material may be formed of gyprock or another suitable material for the inner side of a wall of a structure, while the outer material may be formed by an impermeable siding or another suitable material for the outer side of a wall of a structure. The person skilled in the art will recognize that even other logical variations and embodiments of insulated panels, whose uses in the disclosed structure are encompassed in this application. In some embodiments, there may not be an inner insulating material, or there may be no sides of the panel where the insulation material is exposed. Reference "insulated panel", "insulation panel" or "panel" is meant to encompass all possible variations of insulated panels.

In some embodiments, the insulated panels are assembled onto the rigid frame and held in place using metal-to-metal adhesive. The adhesive may be applied to the sides of either the insulated panels or the rigid frame. In other embodiments, the insulated panels may be assembled onto the rigid frame in other fashions, such as via nails, bolts, other kinds of adhesive or welding, or may rest against or on the rigid frame if the mechanical construction of the insulated panels or the rigid frame allows for it, without the need of additional connection.

In some embodiments, the insulated panels may be different than described above. They may be formed from different materials, such as by aluminum instead of steel, they may have different forms of insulation, such as having a middle layer of wood instead of insulation foam, they may not contain a middle layer at all, they may have their outer layer fully cover the inner layer at all sides, or any number of variations.

In some embodiments, insulated panels can be outfitted with a variety of connecting or locking features. For example, insulated panels may come with features that permit the alignment and locking of insulated panels side by side. Such a feature may involve interlocking groves between panels that fit into each other, or small pieces of metal that can be inserted between connections to lock the panels in place. Connecting and locking features of insulated panels may allow them to form permanent or non-permanent connections between insulated panels in similar orientations (such as two insulated panels that sit side by side, forming a wall) or different orientations (such as two insulated panels that are perpendicular to each other, forming a connection between wall-floor). The combination of multiple panels, potentially via the connecting or locking features, may, eliminate some weaknesses in the insulated panels, such as by hiding parts of the insulated panel where the middle, insulation layer is exposed.

In some embodiments, the structure may also be outfitted with architectural elements. Architectural elements may include windows, doors, stairs, or any number of fixtures, features, or access points for any number of functions. Architectural elements are generally understood to mean additional features that require a hole in the panels that form the walls, floor or ceiling of the structure, for example, a window or a door. An example of an access point may be the presence of a hole in the floor of the structure for the purposes of installing basic plumbing on site. An example of a fixture may be the presence of a steel support, connected to the rigid frame, on the wall of a structure for the purposes of supporting a heavy illumination device that will be installed on site.

In some embodiments, the presence of architectural elements will affect the fabrication of the structure. In some embodiments, this may include relatively minor changes, such as leaving a hole in one of the walls of insulated panels for the installation of a window. In such an embodiment, the weight of the architectural element may be borne by the insulated panels. In other embodiments, this may include relatively major changes, such as the installation of a door frame connected to and supported by the rigid frame of the structure. In such an embodiment, the weight of the architectural element may be borne by the rigid frame. The fabrication of the structure is modular and can accommodate a number of architectural elements. The architectural elements may require changing one or more parts of the structure, such as changing the insulated panels or rigid frame.

In some embodiments, additional pieces of rigid material, such as metal sheets, may be placed along the holes to cover, seal, or insulate the inner insulating material of the panel if there is one, and to disperse the weight of the architectural element to be inserted in the hole. In one example, if a hole is made in a panel, in which a door will be placed, a sheet of metal may be placed to line the hole in the panel to insulate inner insulating material and distribute the weight of the door or of people stepping on the door frame.

Figure 2A:
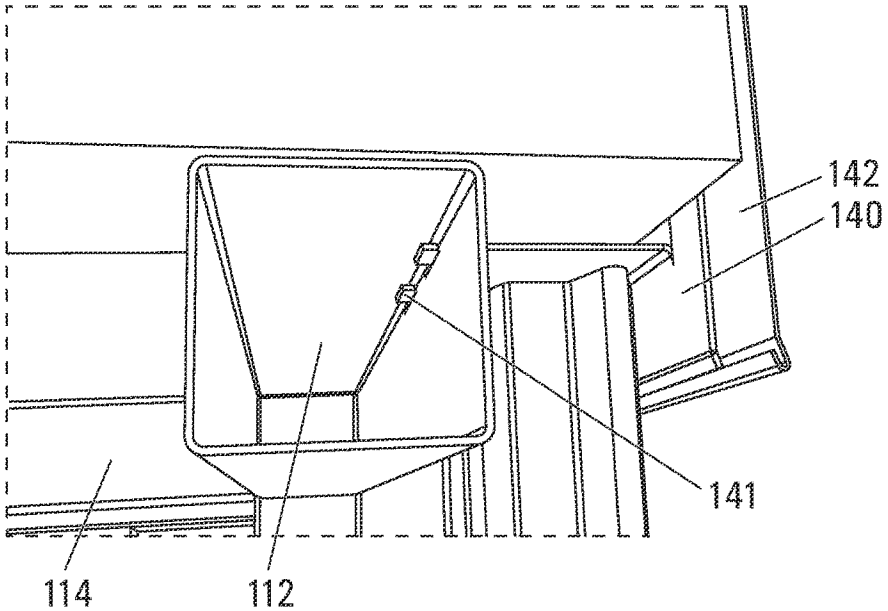
FIG. 2A illustrates a bracket supporting a top of wall panels along with a flashing covering a side edge of a roof panel.
Figure 2B:
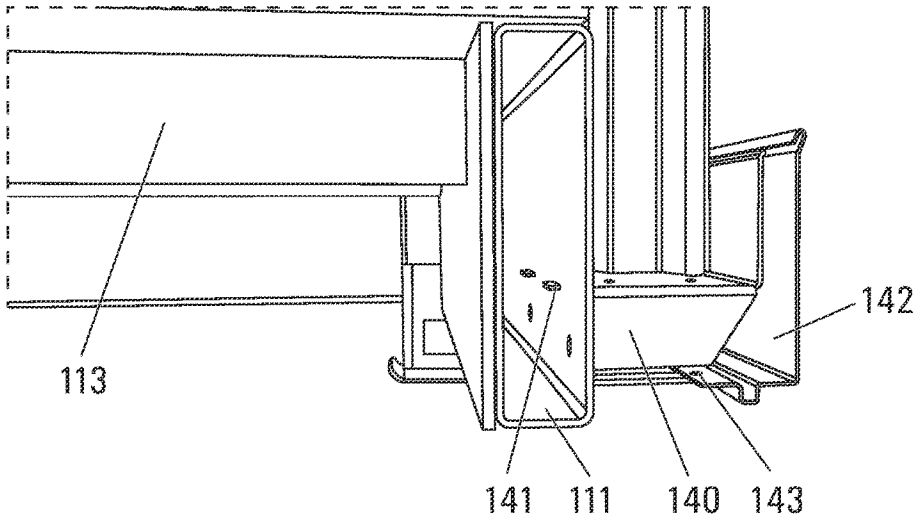
FIG. 2B illustrates a bracket supporting a bottom of wall panels including a kick flashing.

FIG. 2A and FIG. 2B illustrate the implementation of brackets 140. In some embodiments, brackets 140 may be installed in the rigid frame of the structure 100. The brackets 140 may be made of steel, or any number of materials, similar to the rigid beams. In a preferred embodiment, brackets 140 may have a groove in which panels may be placed. In a preferred embodiment, a structure may have brackets 140 for holding the bottom and top of insulated panels such that the walls may be completely supported and immobilized in the brackets.

In some embodiments, the groove of the brackets 140 may have a width according to the insulated panel to be used. For example, in colder climates, a thicker insulated panel may be used, and thus brackets with a thicker groove may be used. In a preferred embodiment, the width of the groove is around the same size as the width of the insulated panel, such that the panel may fit snugly in the groove.

In some embodiments, the brackets 140 may be connected to the rigid frame by the roof support beam 112 or the floor support beam 111. In FIG. 2A, the bracket 140 is shown to be connected to the roof support beam 112. In FIG. 2B, the bracket 140 is shown to be connected to the floor support beam 111. In other embodiments, the brackets 140 may be connected to different structures of the rigid frame. In some embodiments, brackets 140 may also be included for holding, sealing, providing support or immobilizing the roof or floor.

In some embodiments, the brackets may contain short extensions 141 that allow them to automatically snap into the rigid frame at some interval. This auto-snap feature may reduce assembly time and effort in comparison to other methods of connection, such as welding. This may be especially useful if assembly is to be performed on site with limited access to specialized equipment or personnel.

In some embodiments, the brackets may hold the insulated panels 120 of walls, floors, or ceilings in place during assembly. This may reduce assembly time and effort by making it easy to load insulated panels onto the brackets and align them side by side. This may be especially useful if assembly is to be performed on site with limited access to specialized equipment or personnel. The brackets may come in a variety of shapes other than the one shown in FIG. 2A or FIG. 2B, to hold different kinds of insulated plates or allow for different types of connections, such as for ceilings or corners.

In a preferred embodiment, brackets 140 may be small structures that hold only the corners of insulated panels in place. Such brackets are shown in FIGS. 2A and 2B. This may reduce the weight of the overall structure and the cost of material, as the brackets may be formed of heavy, expensive rigid material. The brackets 140 may run along the structure, and further contribute to the insulation of the panels they hold.

In some embodiments, the insulating panels may be connected to the brackets, such as by metal-to-metal adhesive.

In some embodiments, the brackets may be used in ways not shown in FIG. 2A or FIG. 2B, such as for holding insulated panels that form the roof or floor of the structure. Brackets used in ways not shown in FIG. 2A or FIG. 2B may have different structures.

Figure 2C:
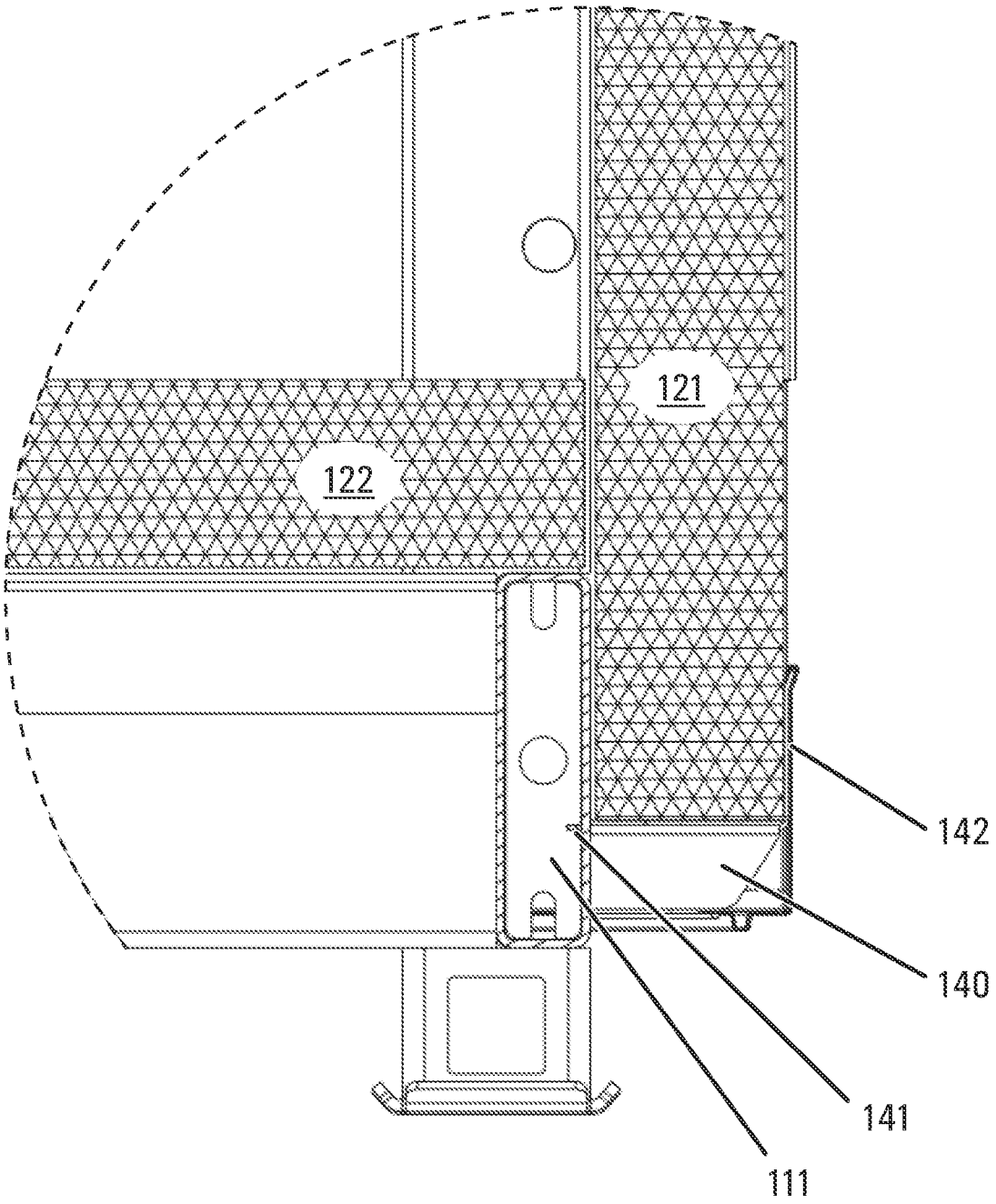
FIG. 2C is a partially sectional detail of a bottom corner of a building showing insulated panels attached to the frame.
Figure 2D:
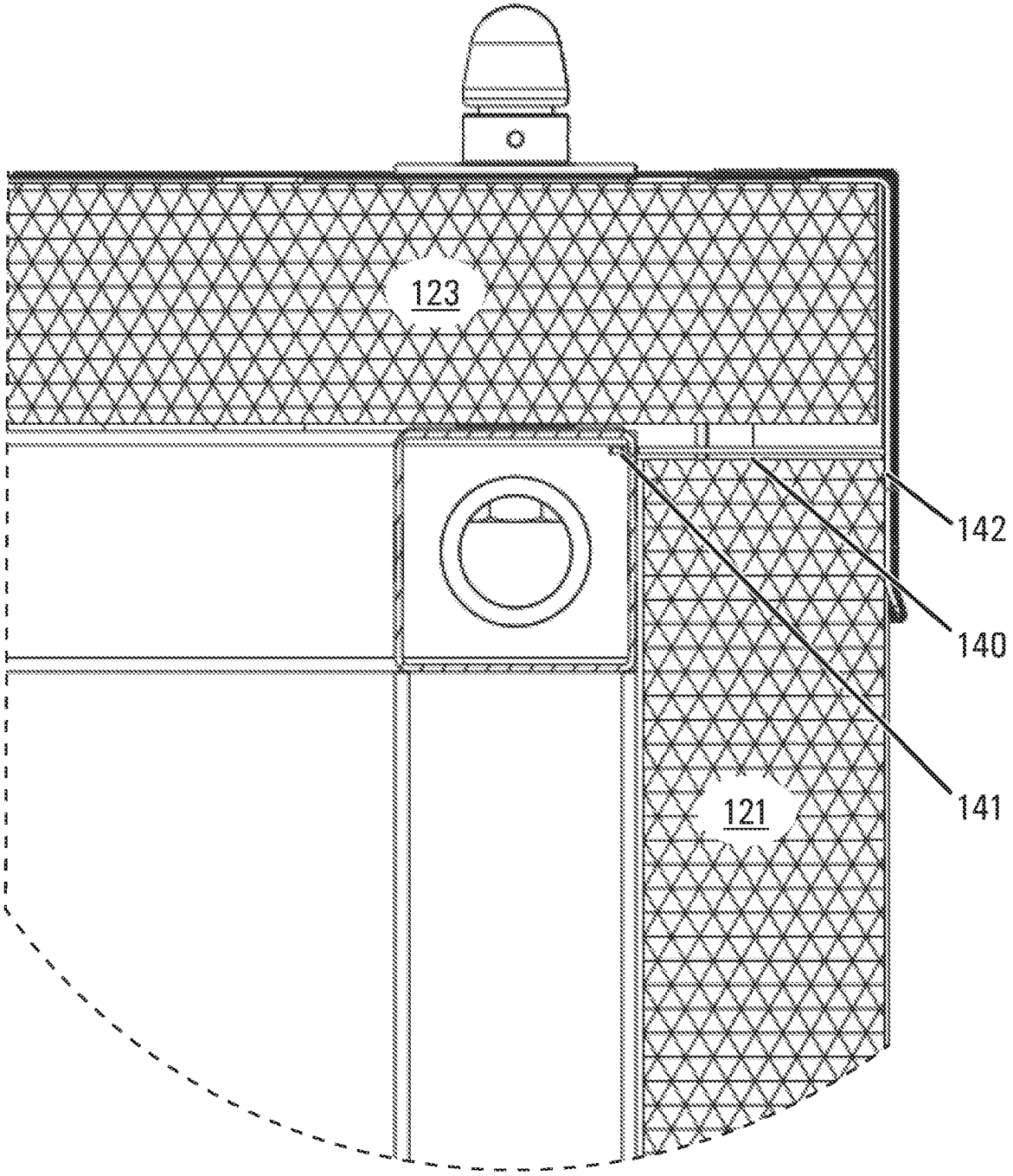
FIG. 2D is a partially sectional detail of a top corner of a building showing insulated panels attached to the frame.

In some embodiments, the structure may additionally include flashings 142, as seen in FIGS. 2C and 2D. In FIG. 2C, the flashing 142 can be seen covering the bracket 140, and the insulated panel forming the wall 121. In some embodiments, such as the one illustrated in FIG. 2D, flashing 142 may provide further insulation to the structure by acting as an additional barrier preventing the entry of moisture, dust, dirt, or other into the groove formed by the bracket, in the bracket itself, or in the connection between the bracket and the rigid frame. In one embodiment seen in FIG. 2D, the flashings 142 may be used to cover the ends of the insulated panels that form the roof 123, thus protecting the insulation from outer elements such as wind, moisture, or rodents. The flashing 142 runs along the bracket 140 and over the roof 123. In some embodiments, flashing 142 may alternatively provide a merely aesthetic benefit. Further examples of flashings 142 may be seen in FIGS. 2A and 2B.

In some embodiments, the brackets 140 may further comprise small extensions and the flashings may further comprise small holes 143 such that the flashings 142 may snap into the brackets 140. In some embodiments, holes on brackets. In some embodiments, the presence of the snap feature may be useful for easy and efficient assembly, especially if assembly is to be performed on site with limited access to specialized equipment or personnel. Examples of flashings 142 with holes 143 may be seen in FIG. 2B.

Figure 2E:
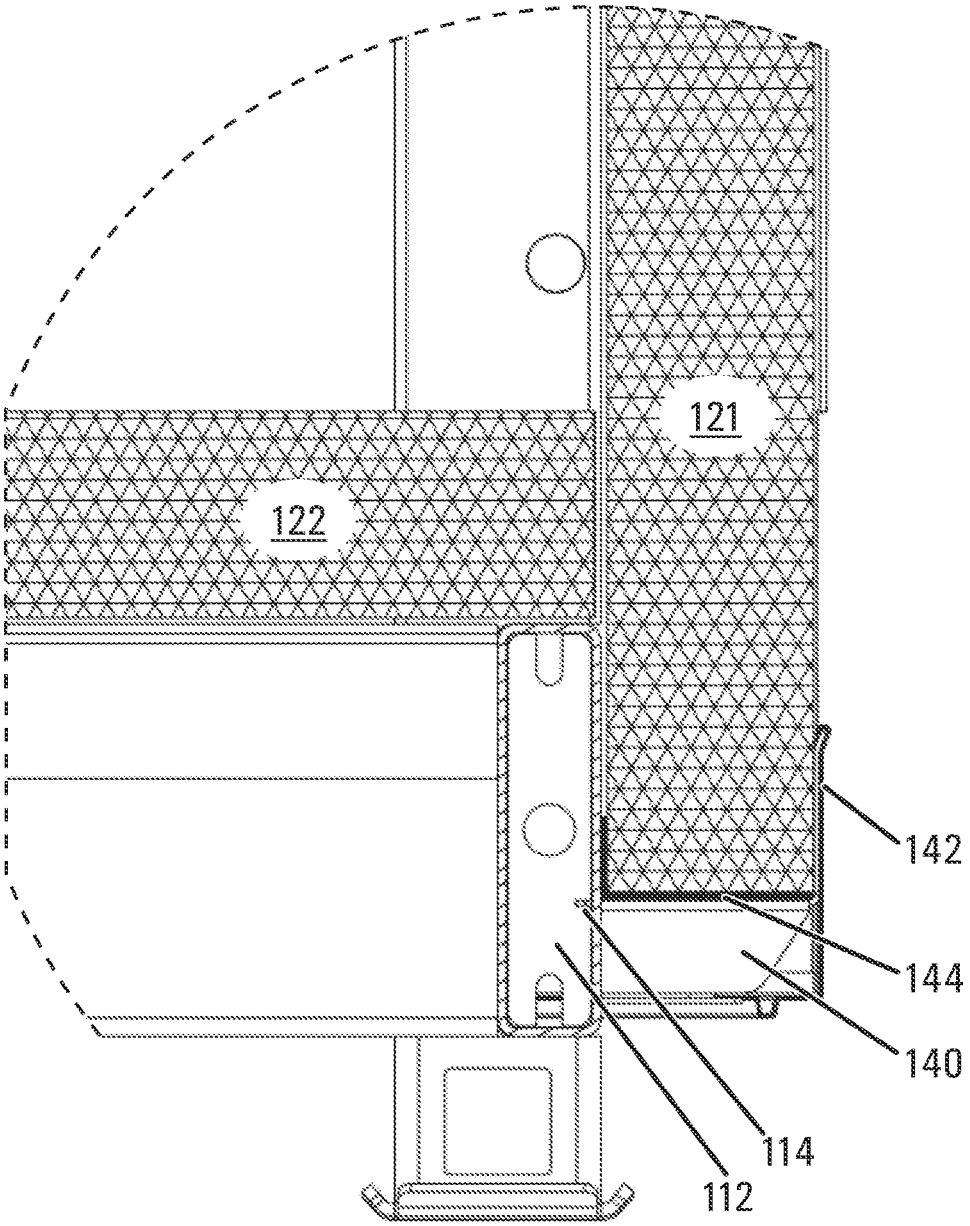
FIG. 2E is a partially sectional detail of a bottom corner of a building showing insulated panels attached to the frame with a cover plate covering a foam exposed edge of the insulated panel.

In some embodiments, such as the one illustrated in FIG. 2E, the structure may further include a rigid plate 144 that can cover an exposed end of an insulation panel. In this embodiment, the bracket 140 may not cover all the bottom of the wall 121 but may merely hold up the ends of the insulation panels forming the wall 121. Thus, there may be needed a rigid plate 144 for covering the side of the insulation panel where the foam is exposed. This may be useful for protecting the insulation panels from various elements, such as rodent damage, water damage, etc. In some embodiments, the rigid plate may run along all the wall 121, and thus be in between the bracket 140 and the insulation panels forming the wall 121. In some embodiments, the rigid plate may wrap around the insulation panel to further isolate the inner insulation material. In some embodiments, a rigid plate may be connected to each individual insulation panel, ensuring that each insulation panel is individually protected. The rigid plate 144 may be placed in the groove of the bracket prior to placement of the insulation panels or may be placed on the insulation panels prior to placement into the groove of the bracket 140.

Based on the various parts, aspects and variations described above, a person skilled in the art would be able to outfit a number of structures with desired characteristics. Depending on certain choices of materials, or desired goals of use of the structure, certain additional requirements may need to be addressed. For example, if the rigid frame or rigid beams are to be made of a flammable material such as wood, or if the insulated panels have an inner side that is flammable, certain additional precautions may be needed to prevent fire hazards. Fireproofing of the structure may be accomplished by lining or covering flammable surfaces with non-flammable materials, such as covering wooden beams with gyprock or painting the inner side of insulated panels with a fire-resistant paint or finish.

Certain material considerations may also have an impact on other aspects of the building. For example, if a structure is made with rigid beams of steel, it is possible that electrical components may be run through the hollow beams of steel. This may not be possible in similar structures made of wooden beams, as the interplay between wood and electrical components may create a fire hazard.

Finally, there may be environmental considerations that may play a part in the planning of the structure. In some embodiments for example where the infiltration of water or moisture is an issue, an impermeable membrane may be placed on the top of the structure to cover it and divert water to the sides of the structure. Alternatively, such a membrane may be imbedded in the structure, such as by being between the brackets and the flashings and therefore held in place by the presence of the flashings.

Figure 3A:
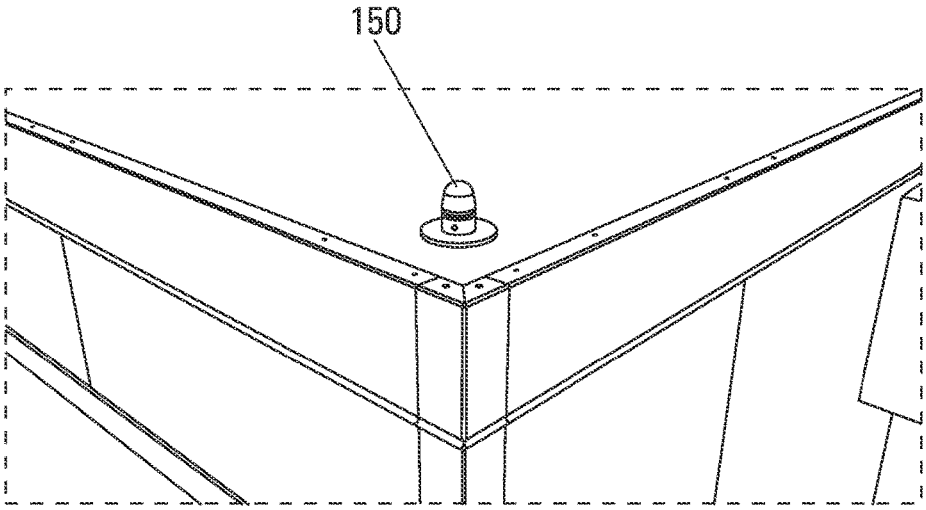
FIG. 3A illustrates a stacking interface protruding from a roof panel.
Figure 3B:
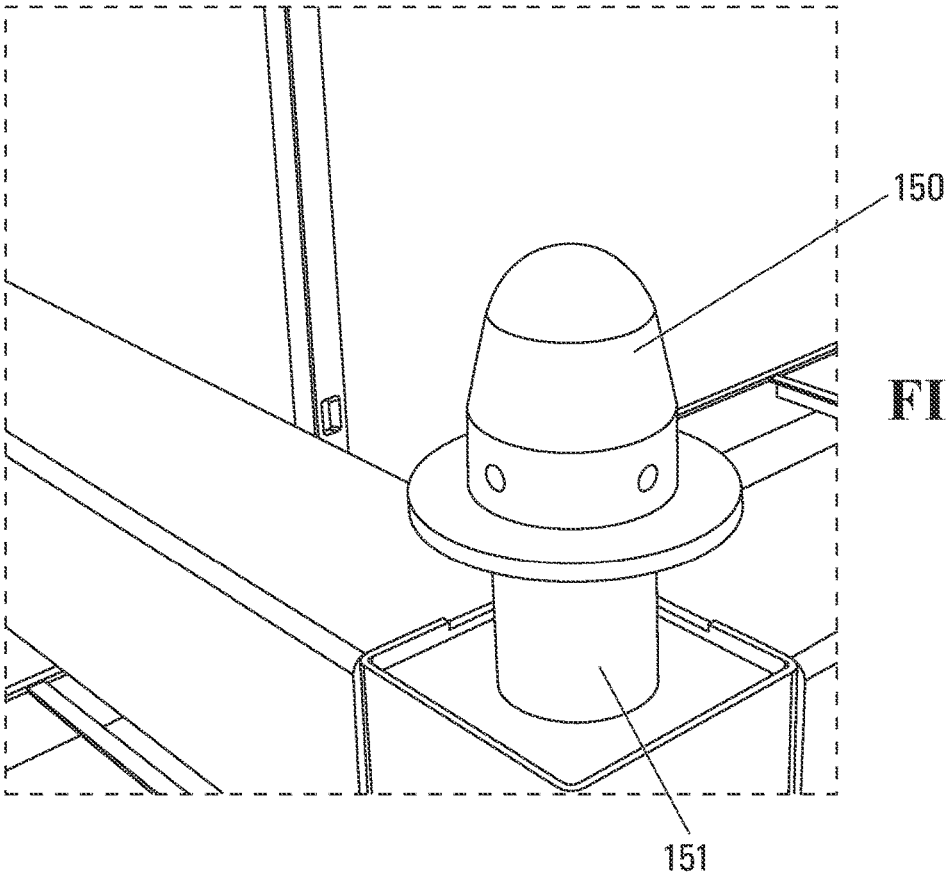
FIG. 3B illustrates the stacking interface mounting to a corner of the frame without the roof panel.

FIG. 3A and FIG. 3B illustrate the stacking interface 150. In this exemplary embodiment, the stacking interface is present on each corner of a rectangular rigid frame 110 and is connected to the rigid frame 110. In this exemplary embodiment, the shape of the stacking interface is bulb-like but narrowing toward the end. This shape may allow for more convenient stacking. The narrower part of the bulb may allow for the bulb to more easily be paired with the foot of a structure that is being stacked. The narrow part of the bulb may slowly give way to a thicker part. In practice, the foot of the structure that is being stacked may slide down onto the stacking interface from the narrow part to the thicker part. The process of sliding down onto the thicker part may more precisely locate the foot of the structure that is being stacked onto the stacking interface. Once the sliding process is complete, and the foot rests fully on the stacking interface, the structures may be aligned with sufficient precision. The stacking interface may then be coupled to the foot of the structure that is being stacked, to fix the position of the structure that is being stacked.

In a preferred embodiment, the stacking interface is made of steel, allowing it a high degree of rigidity and strength. In other embodiments, the stacking interface may be made of different materials of varying characteristics.

In some embodiments, the stacking interface may be accessible above the layer of insulated panels that form the roof of the structure. If this is the case, the insulated panels may require a hole to allow the stacking interface to connect with the rigid frame.

In some embodiments, the stacking interface may have different shapes than the bulb-like protrusion discussed above to accomplish the goal of stacking structures together.

In some embodiments, the stacking interface may be removable from the rigid frame. For example, the stacking interface may have a long, threaded section 151 that can screw into the rigid frame of the structure, allowing easy insertion or removal. In other embodiments, the stacking interface may be welded directly into the rigid frame.

In some embodiments, the number and placement of stacking interfaces on a structure may vary. The placement of stacking interfaces on a structure may be informed by the shape and size of a structure, user preference, or any number of factors. For example, a small, rectangular structure may have a stacking interface at each corner. In another example, a larger rectangular structure may have a stacking interface at each corner and also some stacking interfaces along the edges of the roof. In another example, a U-shaped mobile unit may have stacking interfaces all along the edges of the roof. In some embodiments, stacking interfaces may be places not only on the roof, but the sides and underside of a structure for horizontal stacking or better vertical stacking.

Figure 4:
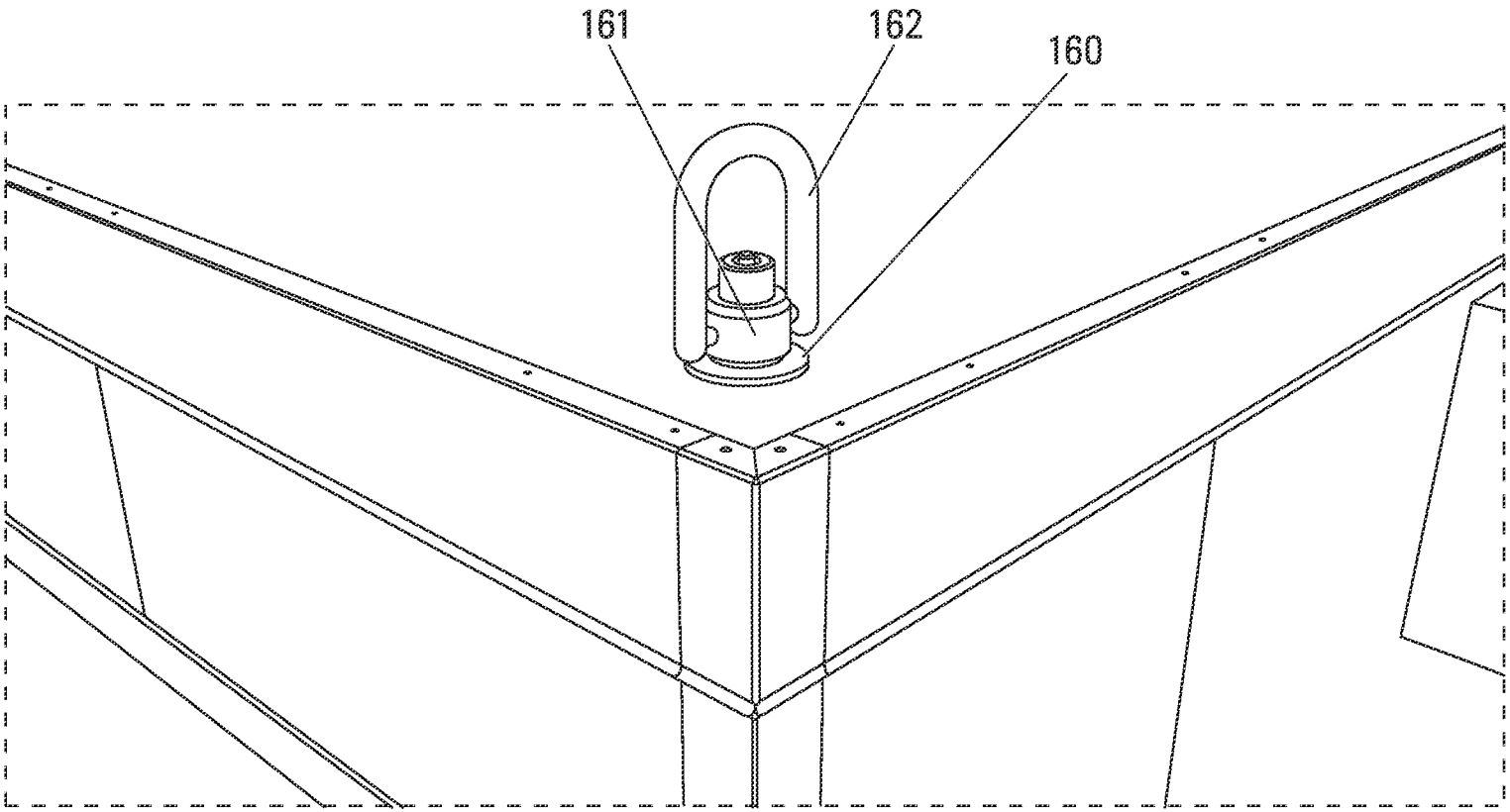
FIG. 4 is an oblique view showing a lifting interface.

FIG. 4 is an oblique view showing the lifting interface 160. In this exemplary embodiment, the lifting interface 160 is present on each corner of a rectangular rigid frame and is connected to the rigid frame. In this exemplary embodiment, the lifting interface 160 may include a part that is attached to the rigid frame 161 and a part in the shape of a half cylinder 162. The two parts come together, forming a hole between them. This shape may allow for more convenient lifting. The hole formed by the two parts of the lifting interface allows the user to attach lifting machinery to the lifting interface, such as ropes, chains, or clips. The half cylinder may be able to move relative to the part attacked to the rigid frame, tilting side to side depending on the direction it is being pulled.

In a preferred embodiment, the lifting interface is made of steel, allowing it a high degree of rigidity and strength. In other embodiments, the lifting interface may be made of different materials of varying characteristics.

In some embodiments, the lifting interface may be accessible above the layer of insulated panels that form the roof of the structure. If this is the case, the insulated panels may require a hole to allow the lifting interface to connect with the rigid frame.

In some embodiments, the lifting interface may have different shapes than the part that is attached to the rigid frame and a part in the shape of a half cylinder discussed above to accomplish the goal of lifting structures.

In some embodiments, the lifting interface may be removable from the rigid frame. For example, the lifting interface may have a long, threaded section that can screw into the rigid frame of the structure, allowing easy insertion or removal. In other embodiments, the lifting interface may be welded directly into the rigid frame.

In some embodiments, the number and placement of lifting interfaces on a structure may vary. The placement of lifting interfaces on a structure may be informed by the shape and size of a structure, user preference, or any number of factors. For example, a small, rectangular structure may have a lifting interface at each corner. In another example, a larger rectangular structure may have a lifting interface at each corner and also some lifting interfaces along the edges of the roof. In another example, a U-shaped mobile unit may have lifting interfaces all along the edges of the roof. In some embodiments, lifting interfaces may be places not only on the roof, but the sides and underside of a structure for lifting the structure in different orientations.

In some embodiments, the removability of the stacking and lifting interfaces will allow the user to use lifting interfaces to lift a structure into place, and then removing the lifting interfaces, replacing them with stacking interfaces, so that another structure can be stacked on that. In some embodiments, a structure may have both stacking and lifting interfaces at the same time (for example, having stacking interfaces at each corner and lifting interfaces at each edge of a square structure) so that a user need not remove interfaces between lifting and stacking.

Figure 5:
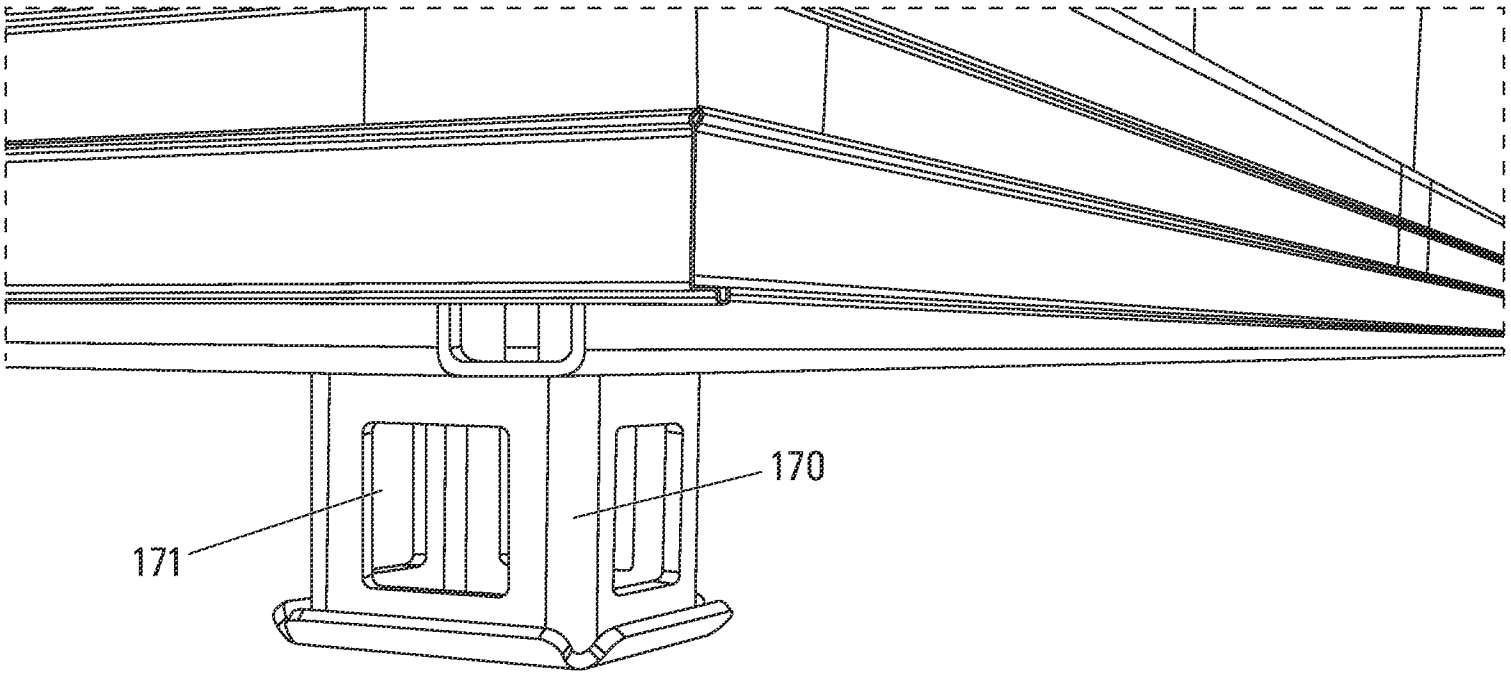
FIG. 5 is an oblique view showing a modular foot.

FIG. 5 is an oblique view showing a modular foot 170. In some embodiments, the structure may have one or more modular feet that can accomplish a variety of functions. FIG. 5 shows the basic version of the modular foot, without any other machinery connected to it. The square holes 171 and the hollow design of the modular foot may allow for it to connect with various add-ons, devices or structures.

In some embodiments, the modular foot may be made of steel, for rigidity, strength and resistance to various kinds of damage. In other embodiments, the modular foot may be made of other materials, such as aluminum.

In some embodiments, the shape of the modular foot may be different. For example, the modular foot may be fabricated with a wider contact point to the ground, if the user intends to use it in a swampland where heavy objects can sink into the ground. The modular foot may also be designed with different holes or connecting interfaces for connection with an even greater number of add-ons, devices or structures.

Figure 6:
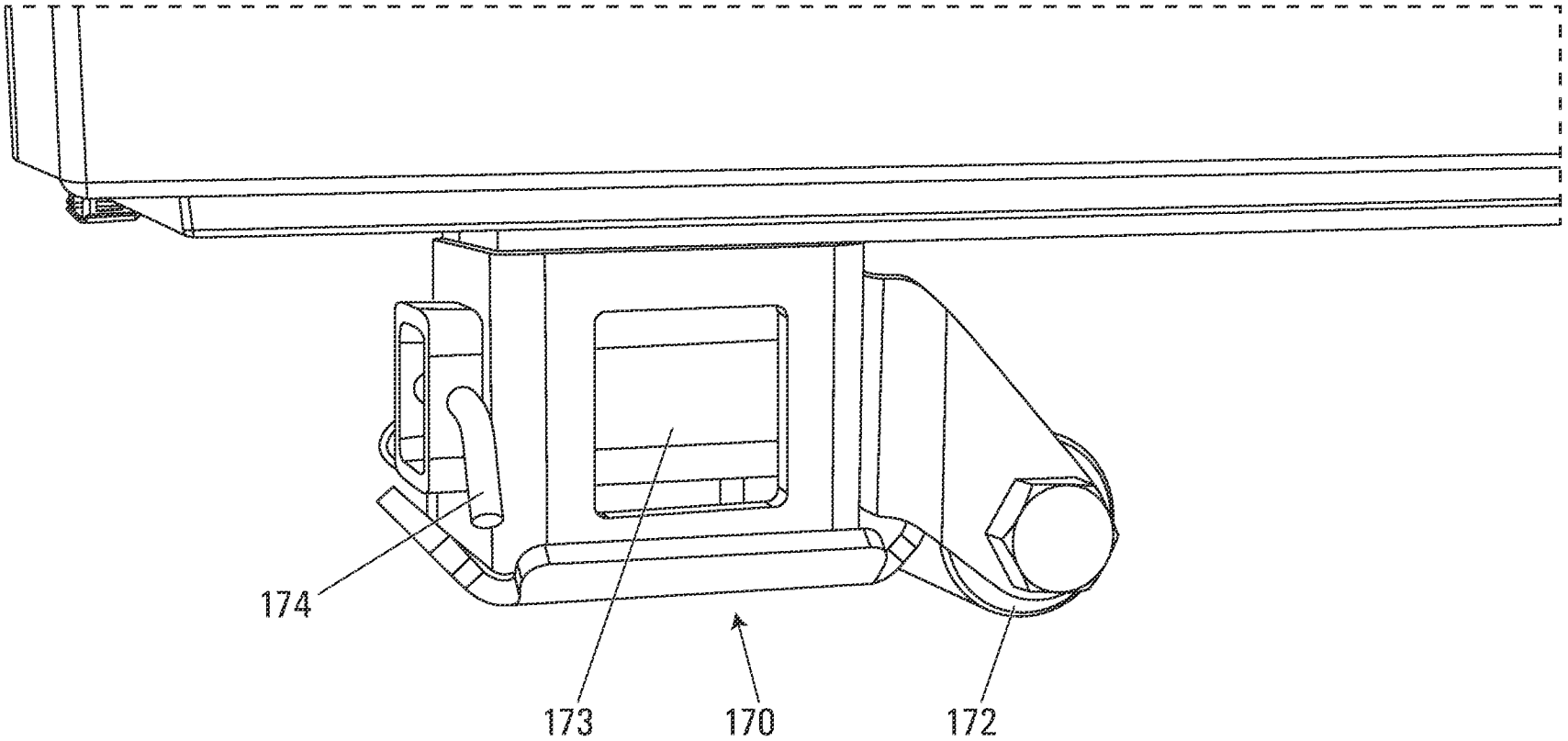
FIG. 6 is an oblique view showing a modular foot connected to a wheel.

FIG. 6 an oblique view showing a modular foot 170 connected to a wheel 172. In this exemplary embodiment, the modular foot 170 may be inserted with an add-on made of a wheel 172 attached to a square metal rod 173 that can be inserted into the square hole of the modular foot 170. The wheel add-on may be held in place by a pin 174 to prevent it from accidentally being removed.

Figure 7A:
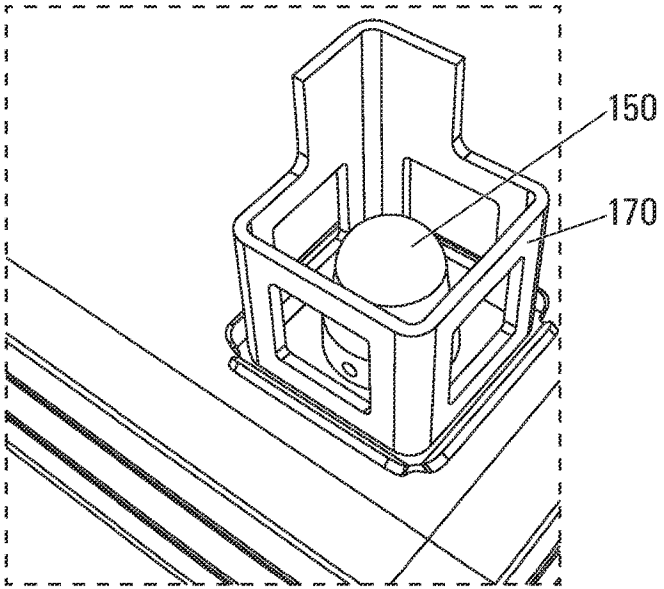
FIG. 7A is an oblique view showing a modular foot connected onto a stacking interface.
Figure 7B:
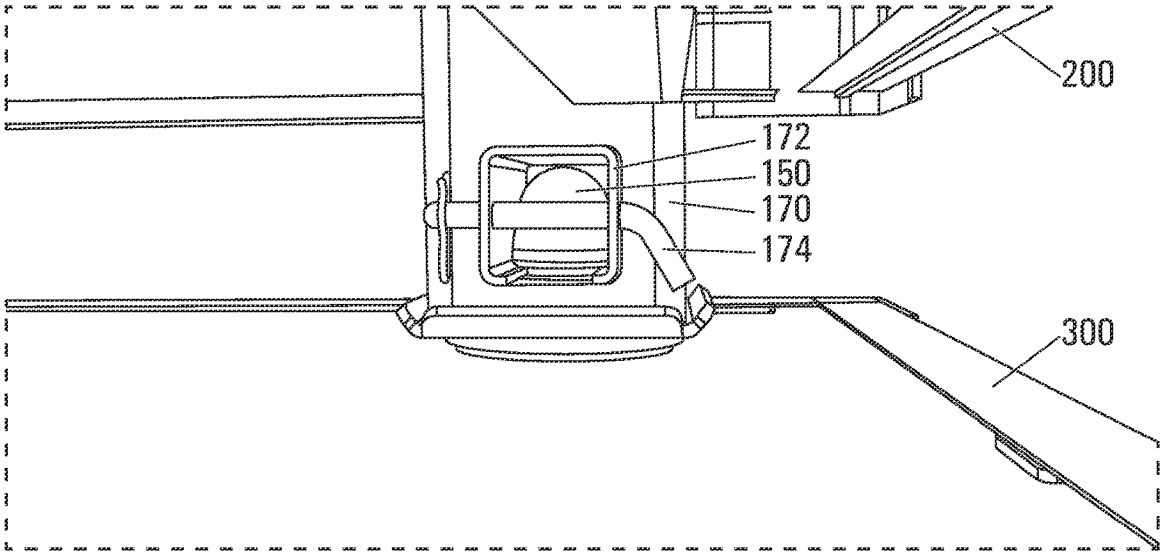
FIG. 7B shows the modular foot connected to its frame.

FIG. 7A and FIG. 7B illustrate a modular foot 170 connected to a stacking interface 150. In this exemplary embodiment, two structures may be stacked together, with the stacking interface 150 of the lower structure 300 having been inserted into the modular foot 170 of the higher structure 200. Once the connection has been made, a square piece of metal 172 may be inserted through the holes of the modular foot to lock the stacking interface of the lower structure into the modular foot of the higher structure. Additionally, a pin 174 may be used to lock the square piece of metal in place, acting as a second lock to ensure that the lower structure and higher structure remain locked in place.

Figure 8:
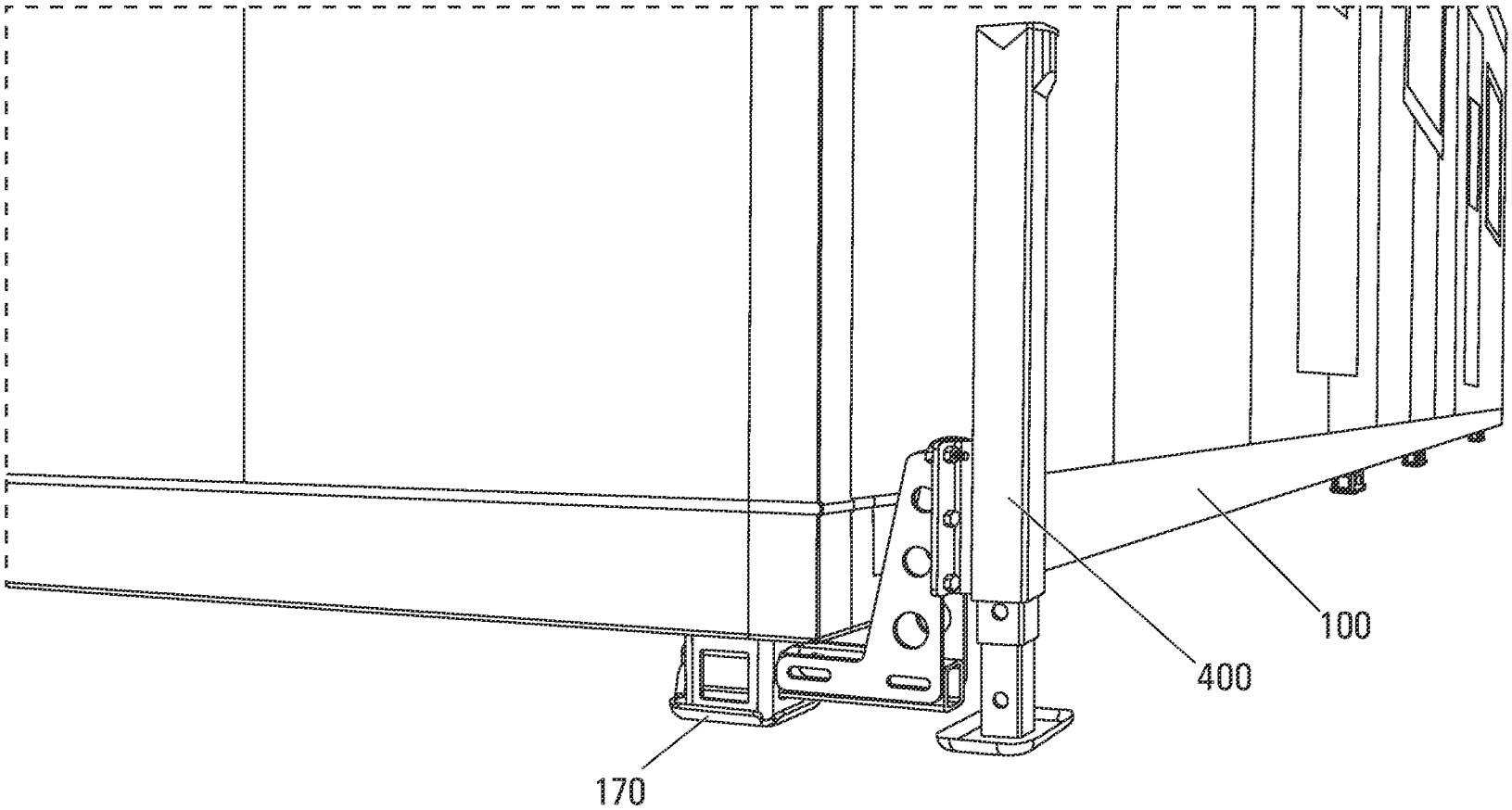
FIG. 8 is an oblique view showing a modular foot connected to an external device, here, a jack.

FIG. 8 is an oblique view showing a modular foot 170 connected to an external device, here, a jack 400. In this exemplary embodiment, the jack may be used by the user or assembler to lift the structure 100. This may provide additional convenience, or critical access to the underside of the structure.

In some embodiments, the modular foot may be used for other functions. One example of a functions may be for the shipping of the structure from the manufacturer to the eventual user. The modular foot would allow for a shipper to easily secure the structure, improving safety and convenience.

Figure 9A:
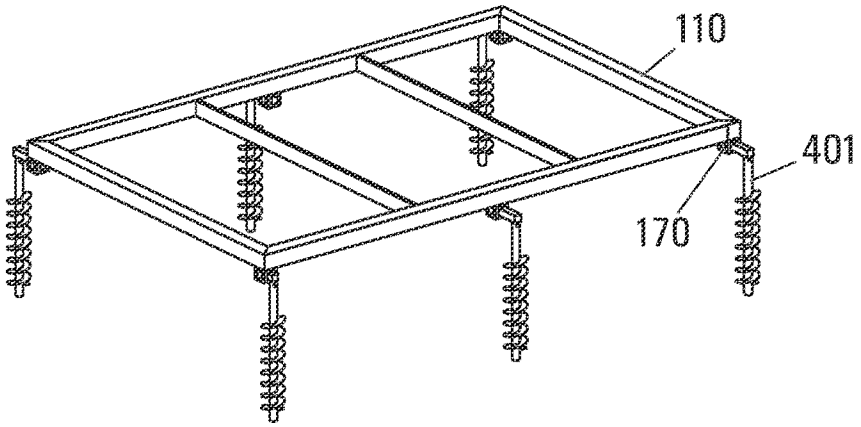
FIG. 9A is an oblique view showing a rigid frame with six modular feet connected to external devices, here, screws for anchorage in the ground.
Figure 9B:
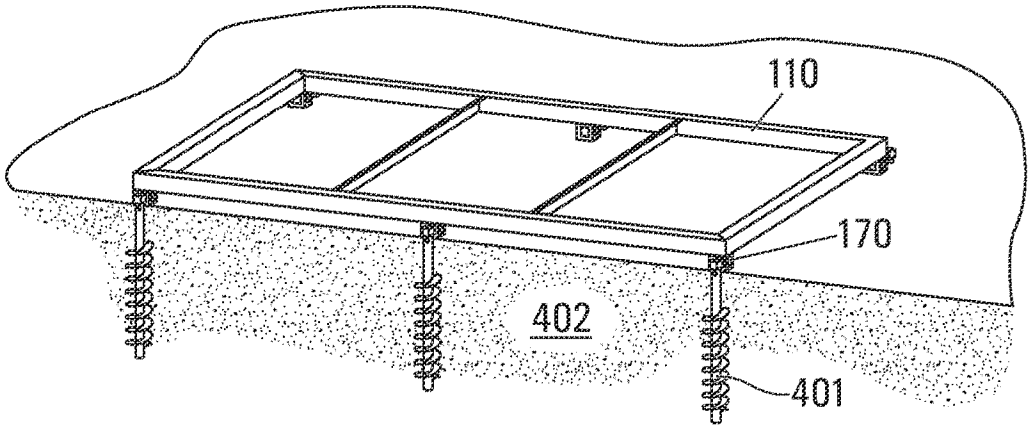
FIG. 9B is an oblique view showing the rigid frame anchored into the ground via the screws.

FIG. 9A is an oblique view showing a rigid frame 110 with six modular feet 170, where the six modular feet 170 are each connected to an external device, here, a screws 401. In this exemplary embodiment, the screws 401 may be used to anchor the rigid frame 110, and by extension the structure (not shown) built on the rigid frame 110, within the ground 402. FIG. 9B is an oblique view showing the rigid frame 110 anchored into the ground 402 via the screws 401. Having the rigid frame 110 screwed into the ground 402, as opposed to merely resting on the ground 402, may provide advantages in stability for the structure, such as resistance to being toppled over by a strong wind. Additionally, having the modularity of removing or adding the screws 401 to the modular feet 170 allows the structure to be moved on or off of its ground anchorage at the convenience of the user.

In some embodiments, the screws 401 may be pre-drilled into the ground, and the structure installed afterward. In some embodiments, there may be a further, interconnecting piece between the modular feet and the vices, especially when the screws 401 are pre-drilled into the ground, that allows for some flexibility in connection between the screws 401 and the modular feet in case there is small discrepancy between the locations of the screws 401 and the positions of the modular feet. In some embodiments, only some modular feet may be outfitted with vices.

In the exemplary embodiments of FIGS. 9A and 9B, the screws 401 are connected via the square holes (171 in FIG. 5) in the modular feet 170, but in other embodiments, the screws 401 may connect underneath the modular feet 170 much like the stacking interface 150 connected to the modular feet 170 shown in FIG. 7A and FIG. 7B. The type of connection may play an important part in the ease of assembly. For example, it may be easier to install the structure on pre-drilled screws 401 if the screws 401 connect to the underside of the modular feet 170 of the structure, allowing the installer to simply lower the structure onto the pre-drilled screws 401.

Figure 10A:
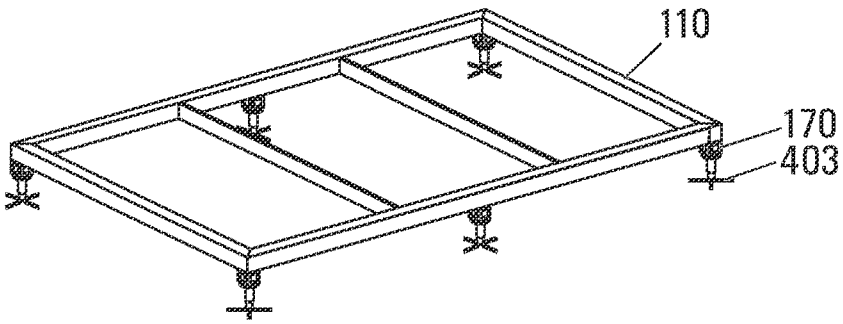
FIG. 10A is an oblique view showing a rigid frame with six modular feet connected to external devices, here, extensions for anchorage into a concrete foundation.
Figure 10B:
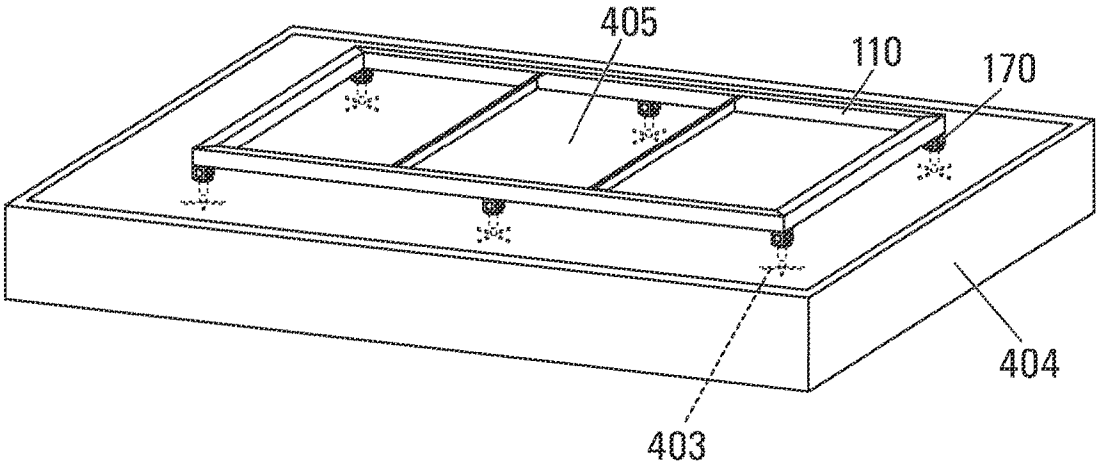
FIG. 10B is an oblique view showing a rigid frame anchored into a concrete foundation via the extensions.

FIG. 10A is an oblique view showing a rigid frame 110 with six modular feet 170, where the six modular feet 170 are each connected to an external device, here, extensions 403. In this exemplary embodiment, the extensions 403 may be used to anchor the rigid frame 110, and by extension the structure (not shown) built on the rigid frame 110, within a concrete foundation 405. In this context, the word 'foundation' takes a non-limiting meaning and could refer to a variety of structures including the more extended foundation of a house, a concrete slab encompassing the area under the structure (as shown in FIG. 10B 405), or multiple slabs of concrete encompassing a smaller area under one or more modular feet 170. FIG. 10B is an oblique view showing the rigid frame 110 anchored into a concrete foundation 405 via the extensions 403. In this exemplary embodiment, the concrete foundation 405 is a slab encompassing the area under the structure, delimited by concrete pouring borders 404. Having the rigid frame set into a concrete foundation 405, as opposed to merely resting on the ground, may provide advantages in stability for the structure, such as resistance to being toppled over by a strong wind. Additionally, having the modularity of removing or adding the extensions 403 to the modular feet 170 allows the structure to be moved on or off the concrete foundation 405 at the convenience of the user.

In some embodiments, the extensions may already be in a concrete foundation before the structure is installed on the extensions. In some embodiments, there may be a further, interconnecting piece between the modular feet and the extensions, especially when the extensions are part of a pre-formed foundation, that allows flexibility in the connection between the extensions and the modular feet of the structure in case there is small discrepancy between the locations of the extensions and the positions of the modular feet. In some embodiments, only some modular feet may be outfitted with extensions in concrete foundations.

In the exemplary embodiments of FIGS. 10A and 10B, the extensions 403 are connected underneath the modular feet 170 much like the stacking interface 150 connected to the modular feet 170 shown in FIG. 7A and FIG. 7B, but in other embodiments, the extensions 403 may connect to the modular feet 170 via the square holes of the modular feet (171 in FIG. 5). The type of connection may play an important part in the ease of assembly. For example, it may be easier to install the extensions 403 on the structure via the square holes 171, allowing the installer to not need to go underneath the structure, allowing the installer to simply lower the structure with the connected extensions 403 into a concrete foundation 405.

In some embodiments, the modular feet may be connected to a number of structures to offer the structure more mobility or support. For example, the modular feet may be connected to skis to allow for the structure to be moved along areas with snow or ice. For example, the modular feet may be connected to large wheels or wheeled supports to allow for the structure to be moved over ground. Other possible embodiments are readily imaginable: pontoons, pads, skids, tracks, etc.

Figure 11:
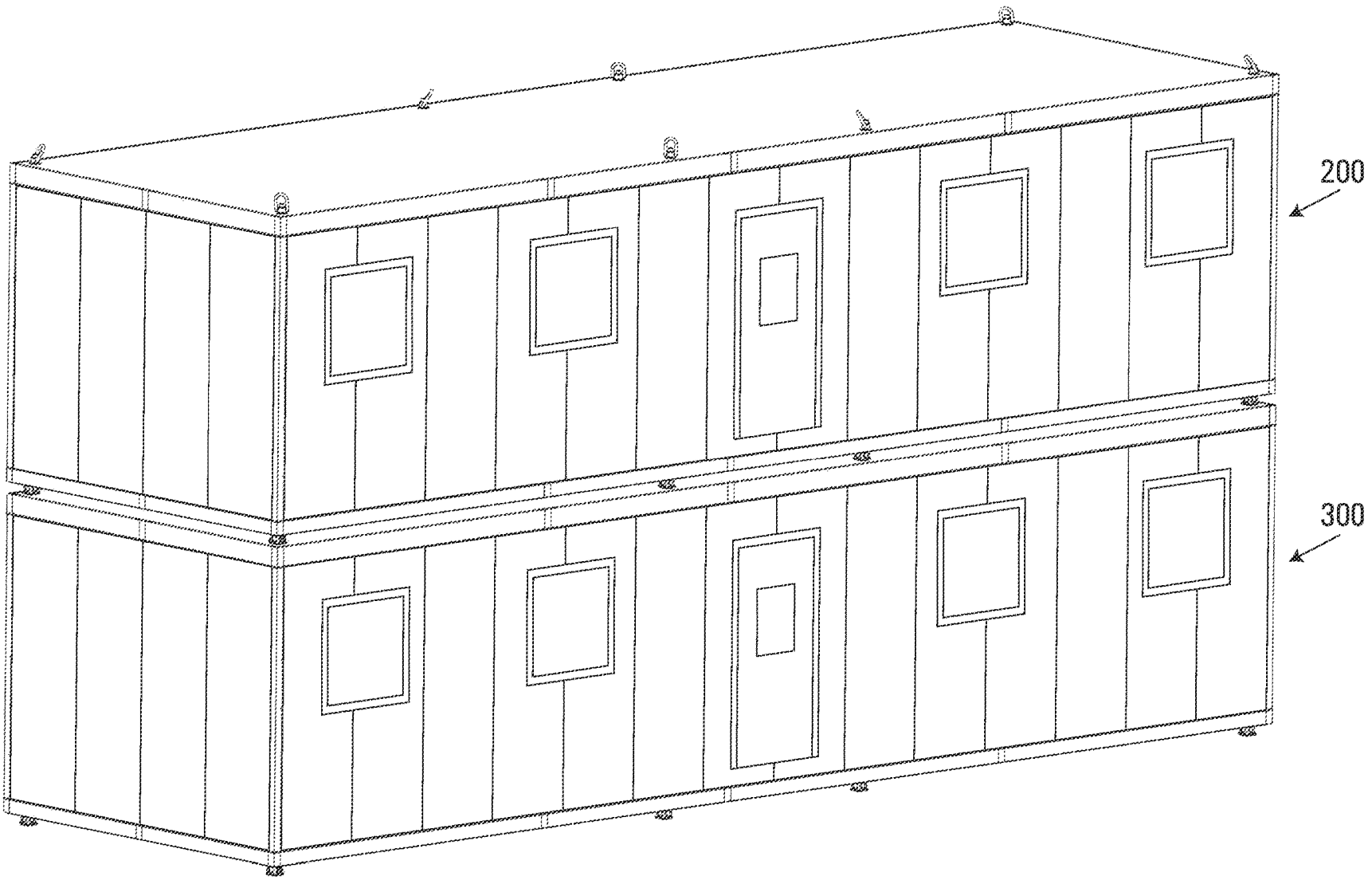
FIG. 11 is an oblique view of two stacked structures.

FIG. 11 is an oblique view of two stacked structures. In this exemplary embodiment, two structures may be stacked one on top of another, connected by the stacking interfaces of the lower structure 300 and the modular feet of the higher structure 200. In some embodiments, more than two structure may be stacked. In some embodiments, two or more structures of different shapes may be stacked. In some embodiments, the structures may be stacked horizontally.

It may be clear to one skilled in the art that the invention is highly modular and may contain implementations not explicitly described in this current disclosure.

Although the invention has been described with reference to preferred embodiments, it is to be understood that modifications may be resorted to as will be apparent to those skilled in the art. Such modifications and variations are to be considered within the purview and scope of the present invention.

Representative, non-limiting examples of the present invention were described above in detail with reference to the attached drawing. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings.

Moreover, combinations of features and steps disclosed in the above detailed description, as well as in the experimental examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

What is claimed is:

1. A building structure comprising:

a rigid frame composed of rigid beams that define wall posts, floor support beams, and roof support beams, the floor support beams define a rigid base assembly further comprised of floor joists and the roof support beams define a rigid roof assembly further comprised of roof joists, the rigid base assembly and the rigid roof assembly are interconnected by the wall posts, the frame being modular to form structures of a variety of dimensions;

a plurality of rigid brackets, each said bracket connected to and supported by the frame including one of the floor support beams and the roof support beams, said brackets comprising a groove extending along a length thereof;

a plurality of insulated panels configured to define walls, a roof and a floor of the structure, wherein the insulated panels forming the walls are placed in the grooves of the brackets such that the brackets support the walls and the insulated panels are held in place by the brackets, the insulated panels forming the roof are connected to and supported by the roof joists and the roof support beams, and the insulated panels forming the floor are connected to and supported by the floor joists and the floor support beams;

a plurality of flashings, each said flashing connected to and supported by one of the brackets, each flashing covers at least part of one of the brackets and one of the insulated panels;

one or more architectural elements imbedded in an aperture of at least one of the insulated panels forming the walls such that the architectural element is accessible from an outside thereof, the imbedded architectural element being at least partly supported by the at least one insulated panel; and at least one upper extension connected to the rigid frame, the at least one upper extension extending through one of the insulated panels forming the roof and protruding thereabove, wherein the at least one upper extension is at least one of:

(i) a stacking interface connected to the frame which is connectable to an identical, second building structure stacked thereon, or (ii) a lifting interface connected to the frame configured to be connected to and lifted by lifting machinery.

2. The structure of claim 1, wherein the frame further comprises apertures and the brackets further comprise extensions that snap into the apertures of the frame, for facilitating installation and locking the brackets into the frame.

3. The structure of claim 1, wherein the flashings further comprise apertures and the brackets further comprise extensions that snap into the apertures of the flashings, for facilitating installation and locking the flashings onto the brackets.

4. The structure of claim 1, further comprising a rigid corner piece comprising three holes each at a 90-degree angle of each other, for forming an intersection of a respective said wall post with two said roof support beams or two said floor support beams.

5. The structure of claim 1, wherein one of the roof joists or the floor joists support the insulation panels forming the roof or the floor.

6. The structure of claim 1, further comprising one or more wheels connected to the frame, that would allow the structure to be moved on wheels.

7. The structure of claim 1, further comprising one or more anchor screws that are drilled into a ground surface and connected to the frame, to anchor the structure to the ground surface.

8. The structure of claim 1, further comprising one or more lower extensions configured to be set in one or more concrete foundations and connected to the frame, to anchor the structure to the concrete foundations.

9. The structure of claim 1, wherein the frame further comprises one or more modular feet capable of connecting non-permanently to one or more said building structures.

10. The structure of claim 9, wherein at least one of the one or more modular feet comprises a hollow middle area in which connecting structures are configured to be inserted and removed from beneath and square holes in which square, rigid rods of the connecting structures are inserted and removed from a side or in which securing machinery is connected to secure the building structure during shipping.

11. The structure of claim 1, wherein each of the insulation panels having rigid foam insulation material bonded to metal covering opposed major surfaces, opposed side surfaces connectable to adjacent said panels, and end surfaces having exposed rigid foam insulation.

12. The structure of claim 11, wherein one of the major surfaces is an innermost layer of the walls of the structure, exposed to an inside of the structure, and an other of the major surfaces is an outermost layer of the walls of the structure, exposed to an outside of the structure.

13. The structure of claim 11, further comprising a rigid plate for covering the exposed rigid foam insulation at the end surfaces of the insulated panels forming the walls of the structure, thereby protecting the inner insulation layer.

14. The structure of claim 1, wherein one or more of the stacking interfaces on the frame allow two or more said building structures to be stacked.

15. The structure of claim 14, wherein the one or more stacking interfaces are configured to connect to modular feet of another said building structure by being inserted from therebeneath.

16. The structure of claim 14, wherein each said stacking interface comprises a bulb-shaped protrusion which is thinner on one end and thicker at an opposite end to facilitate stacking.

17. The structure of claim 1, wherein one or more of the lifting interfaces on the frame which allow for the frame, and by extension the structure, to connect to said lifting machinery and be lifted from one or more of the lifting interfaces.

18. The structure of claim 17, wherein each said lifting interface is connected to the frame via a threaded section on the stacking interface and screwed into a complimentary threaded section on the frame, in a removable manner.

19. The structure of claim 17, wherein each said lifting interface comprises a half-cylinder-shaped donut with a large hole therein configured to be connected to said lifting machinery.

* * * * *